US005480758A

United States Patent [19]

Suwa

[11] Patent Number: 5,480,758

[45] Date of Patent: Jan. 2, 1996

[54] METHOD AND DEVICE FOR THE TRANSFER OF MAGNETIC TONER

[75] Inventor: Yoshihito Suwa, Shizuoka, Japan

[73] Assignee: Tomoegawa Paper Co., Ltd., Tokyo, Japan

[21] Appl. No.: 347,155

[22] Filed: Nov. 23, 1994

Related U.S. Application Data

[63] Continuation of Ser. No. 31,909, Mar. 16, 1993, abandoned.

[30] Foreign Application Priority Data

Mar. 19, 1992 [JP] Japan ..... 4-092410

[51] Int. Cl.[6] ..... G03G 13/14

[52] U.S. Cl. ..... 430/126; 430/106.6

[58] Field of Search ..... 430/126, 106.6

[56] References Cited

U.S. PATENT DOCUMENTS

| | | | |
|---|---|---|---|
| 3,052,564 | 9/1962 | Kulesza | 430/39 |
| 3,712,733 | 1/1973 | Giaimo | 430/39 |
| 4,038,665 | 7/1977 | Neukermans | 346/74.1 |
| 4,411,512 | 10/1983 | Springer | 355/37 R |
| 4,885,223 | 12/1989 | Enoki et al. | 430/122 |

*Primary Examiner*—John Goodrow

*Attorney, Agent, or Firm*—Oblon, Spivak, McClelland, Maier & Neustadt

[57] ABSTRACT

A method of transferring a magnetic toner to a paper sheet includes steps of disposing the magnetic toner on a surface of an image supporting member, superimposing the paper sheet on the surface of the image supporting member, and transferring the magnetic toner to the paper sheet via transferring means, characterized in that the transferring means includes a magnetic material and transfers the magnetic toner to the paper sheet via a magnetic force of a magnetic field produced by the magnetic material.

8 Claims, 3 Drawing Sheets

METHOD AND DEVICE FOR THE TRANSFER OF MAGNETIC TONER

This application is a continuation of U.S. application Ser. No. 08/031,909, filed on Mar. 16, 1993, now abandoned.

BACKGROUND OF THE INVENTION

1. Field of the Invention

The present invention relates to a method of transfer of a magnetic toner to a paper sheet. Specifically, the present invention relates to a method of transfer of a magnetic toner, which has improved transferring characteristics. The present invention also relates to a recording device used in the method of transfer.

Conventional method of development employing a developer for electrophotography, are divided roughly into two main types; a one-component and a multiple-component method of development. The one-component methods of development uses a single-component developer which consists essentially of a magnetic toner.

The following is a description of the developing device employed in electrophotography (i.e. the recording device) and used in the above-mentioned one-component method of development. FIG. 6 shows the conventional developing device. The developing device is composed of a photoconductor 11, an electrostatic generator 12, an exposer 13, a developer 14, a transferring corona generator 15, a fixer device 17, and the like. An electrostatic generator 12, an exposer 13, a developer 14, a transferring corona generator 15, and a fixer device 17 are each positioned around the photoconductor 11. The mechanics of these devices are explained hereinbelow. When the photoconductor 11 rotates in the direction shown by the arrow in FIG. 6, the surface of the photoconductor 11 is uniformly charged by the electrostatic generator 12. Electrostatic latent images are formed by selectively exposing the surface of the photoconductor 11, depending on an image or a picture signal. The electrostatic latent images are developed by applying magnetic toners to the electrostatic latent images with the developer 14. A paper sheet 16 is superimposed on the surface of the photoconductor 11 maintaining the developed magnetic toners. Then the paper sheet 16 is oppositely charged, with respect to the charge of the magnetic toner, by the transferring corona generator 15, and the paper sheet 16 is subsequently torn off from the surface of the photoconductor 11. The image is then recorded by fixing the magnetic toners onto the paper sheet 16 with the fixer device 17.

Besides the above-mentioned method of transfer which employs a corona generator, representative examples of the methods of transferring the magnetic toners maintained on the surface of the photoconductor to the paper sheet include a method using a roller, and a method using a belt, and the like.

In recent years, the electro-photography recording device has become increasingly popular, and a recording device that uses less electrical power has been in demand. Therefore, in order to satisfy such a demand, a recording device which can use magnetic toners which have a low resistance capacity (i.e. approximately $10^4$ ohm cm or less) has been developed. If the magnetic toner has such a low resistance capacity, then the magnetic toner can be applied to a low potential developing system in which the voltage used in developing is 100 V or less. However, the magnetic toner has such a low capacity for resistance that, consequently, there is scattering. The scatter occurs by an electrical charge generated by the transferring corona generator during the process of transferring magnetic toners from the photoconductor to the paper sheet, and by an electrical charge generated on the surface of the paper sheet. As a result, it is impossible to obtain good quality transferred images. The phenomena which cause this problem are explained below. For example, when the magnetic toners are transferred close to where the transferred image is developed, the resolution of the image deteriorates. This phenomenon is called "blur". Moreover, when the magnetic toners on the photoconductor are not uniformly transferred onto the paper sheet and part of the magnetic toners remain on the photoconductor, then part of the image is not transferred. This phenomenon is called "white spot within character". Besides the above-mentioned problems, a practical image density cannot be obtained, and also the efficiency of transfer is low. If the method of transfer using a roller is applied, relatively good transferring properties cannot be obtained.

SUMMARY OF THE INVENTION

In order to overcome the above-described problems, the object of the present invention is to provide a method of transfer of a magnetic toner to a paper sheet which has improved transferring characteristics. The present invention also provides a recording device used in the above-described method.

According to a first aspect of the present invention, a method of transfer of a magnetic toner to a paper sheet is provided, comprising the steps of:

superimposing the paper sheet on the surface of an image supporting member, with said surface maintaining the magnetic toners; and transferring the magnetic toners to the paper sheet by a transferring means; and is characterized in that the transferring means at least includes a magnetic material.

According to a second aspect of the present invention, a recording device of the developer for electrophotography is provided, comprising a transferring means which transfers the magnetic toners to the paper sheet, and is characterized in that the transferring means at least includes magnetic material.

According to a third aspect of the present invention, a method of transfer is provided, which is characterized in that the magnetic force of said magnetic material, which is at least included in the transferring means, is 200 Gauss or more.

According to a fourth aspect of the present invention, a method of transfer is provided, which is characterized in that the magnetic material is at least included, and the magnetic material is a permanent magnet selected from the group consisting of ferrite magnets such as barium ferrite, alnico (Al-Ni-Co), rare earth metal-cobalt, and the like.

FIGS. 1 to 5 schematically show a recording device and a method of transfer of the present invention.

The method of transfer is shown in FIG. 1 and is described hereinbelow. When the image supporting member 1 maintaining the magnetic toner 5 rotates in the direction shown by the arrow in FIG. 1, the paper sheet 2 is superimposed on the surface of the image supporting member 1. The paper sheet 2 is oppositely charged, with respect to the charge of the magnetic toner 5, by the transferring corona generator 3. Then, the magnetic toner 5 is transferred to the paper sheet 2, from the surface of the image supporting member 1, and is fixed to the paper sheet 2 by the fixer device (not shown).

As shown in FIG. 2, a charger wire 6 is positioned inside of the transferring corona generator 3. Moreover, a magnetic material 4 is positioned under the charger wire 6. This type of transferring means, namely the transferring corona generator 3 which at least includes the magnetic material, is a distinguishing characteristic of the recording device of the present invention.

FIG. 3 shows another method of transfer of the present invention and a description of this method is given hereinbelow. When the image supporting member 1 maintaining the magnetic toner 5 rotates in the direction indicated by the arrow in FIG. 3, the paper sheet 2 is superimposed on the surface of the image supporting member 1. Then, the magnetic toner 5 is transferred to the surface of the paper sheet 2 by pressing the paper sheet 2 to the image supporting member 1 by means of a transferring roller 7 and is fixed to the paper sheet 2 by the fixer device (not shown). FIG. 4 shows one kind of transferring means of the present invention used in the above-described method. The outside of the transferring roller is made of silicone rubber, and the inside thereof is made of magnetic material.

FIG. 5 shows another method of transfer of the present invention. This method is described hereinbelow. When the image supporting member 1 maintaining the magnetic toner 5 rotates in the direction indicated by the arrow in FIG. 5, the intermediate transferring member 8 is superimposed on the surface of the image supporting member 1 by the first transferring roller (i.e. pressing roller) 30. When the intermediate transferring member 8 is superimposed on the surface of the image supporting member 1, the magnetic toner 5 is transferred to the surface of the intermediate transferring member 8. Then, the intermediate transferring member 8 rotates in the direction indicated by the arrow while maintaining the magnetic toner 5. While the magnetic toner 5 is maintained on the surface of the intermediate transferring member 8, it is moved to the position between the second transferring roller (i.e. holding roller) 9, and the heating roller 10, and the magnetic toner 5 is pressed to the paper sheet 2 and heated by the heating roller 10. The heated magnetic toner 5 is therefore melted and fixed to the paper sheet 2. In this example, in order to fix the magnetic toner 5 to the paper sheet 2, a fixing system which employs heat is utilized as shown FIG. 5. However, other systems, such as a fixing system which employs pressure, can be utilized. When the fixing system which employs pressure is used, the magnetic material may be included in the pressing roller.

A characterizing feature of the present invention is that the magnetic material 4 is at least included in the transferring means which transfers magnetic toner 5 to the paper sheet 2.

The above-mentioned image supporting member 1 may be a sensitive member made of selenium compounds or organic compounds. In particular, the image supporting member 1 applied in an ion flow system may be made of dielectrics such as hard alumite.

In the method of transfer shown in FIG. 1, the phrase "at least including the magnetic material" means that the container of the transferring corona generator 3 is made of magnetic material and also that the magnetic material is positioned within the container.

In the method of transfer shown in FIGS. 3 and 5, that is the method of transfer which utilizes a roller, the phrase "at least including the magnetic material" means that the transferring rollers 7 and 30 are made of magnetic material and also that parts of the transferring rollers, that is only core parts of the rollers, are made of magnetic material.

The magnetic material used in the method of the present invention is preferably a permanent magnet selected from the group consisting of ferrite magnets such as barium ferrite, alnico (Al-Ni-Co), rare earth metal-cobalt, and the like. Moreover, in order to satisfactorily transfer the magnetic toner to the paper sheet, the magnetic force of the magnetic material used in the present invention is preferably 200 Gauss or more.

Moreover, a composite magnetic toner comprising a magnetic toner and a magnetic carrier can also be applied in the present invention.

DETAILED DESCRIPTION OF THE PREFERRED EMBODIMENTS

The present invention will be explained in detail hereinbelow with reference to the examples.

[EXAMPLE 1]

In order to prepare the magnetic toner, a mixture having the composition listed below, was obtained.

| | |
|---|---|
| * epoxy resin (trade name: Epicoat 1004, marketed by Yuka shellepoxy Co.) | 48 parts by weight |
| * magnetite (trade name: EPT-500, marketed by Toda Industries) | 40 parts by weight |
| * polypropylene resin (trade name: Highmer 330P, marketed by Sanyo Kasei Industries) | 2 parts by weight |
| * carbon black (trade name: Ketjen black EC, marketed by Ketjen Black International Co.) | 10 parts by weight |

The mixture obtained was melted and kneaded by a two-fixture kneading and extruding device, cooled, and then ground by a jet-mill. The magnetic toners were obtained by classifying the particles obtained by the above-described method with an airflow-type classifier. The average diameter of the magnetic toner obtained is 10 μm. The resistance capacity thereof is $0.6*10^4$ ohm cm.

Figure 1:
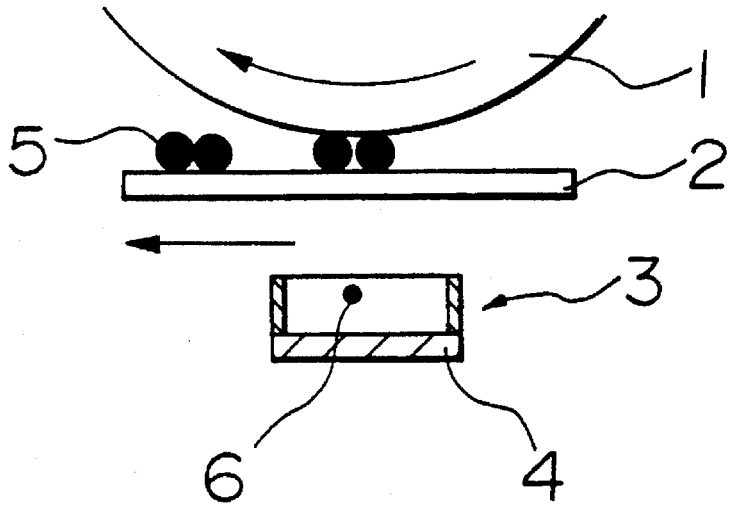
FIG. 1 is a schematic view, showing one method of transfer of the present invention.
Figure 2:
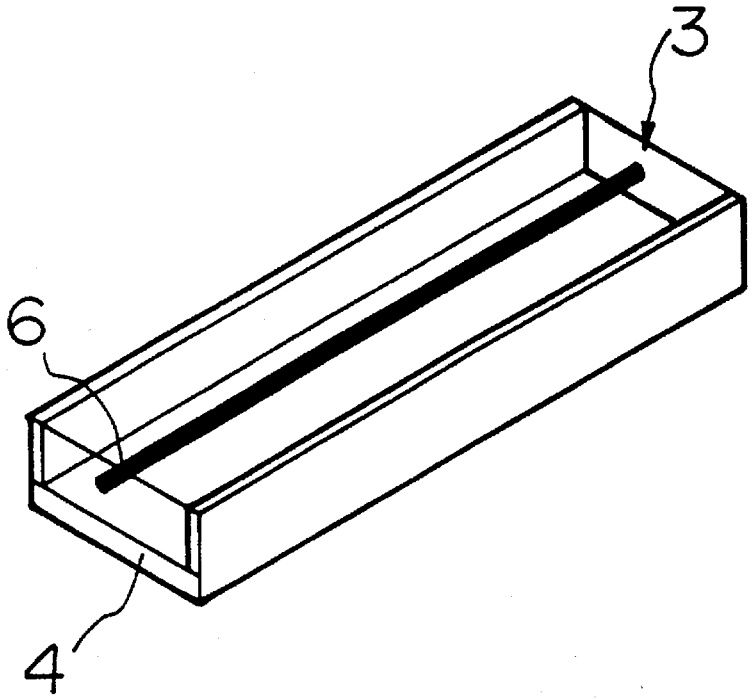
FIG. 2 is a schematic view, showing one kind of transferring means of the present invention.
Figure 3:
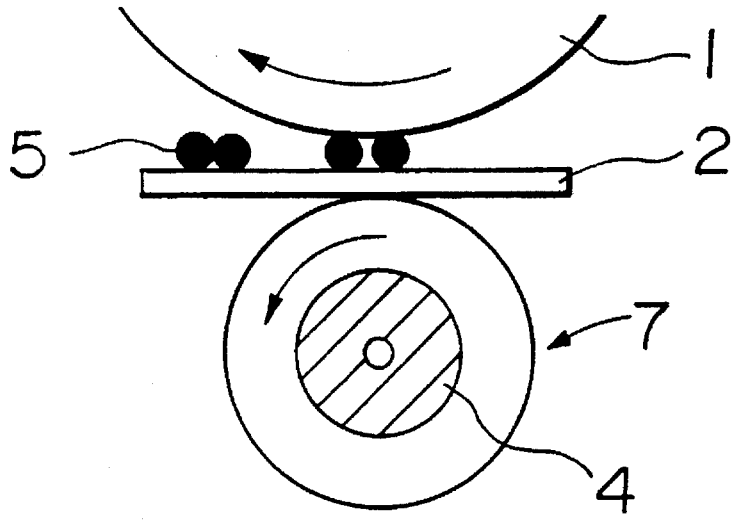
FIG. 3 is a schematic view, showing another method of transfer of the present invention.

As shown in FIG. 2, the magnetic material which is barium ferrite having a magnetic force of 200 Gauss, is positioned on the bottom of the transferring corona generator. The transferring corona generator is built into the electric copying machine of the one-component method of developing (trade name:FP-1530, marketed by Matsushita Electric Co.).

10,000 printings were carried out by the electric copying machine in which the supply of the magnetic toners was provided by toners obtained by the above-described steps. The voltage for developing was set to 100 V. The results of 10,000 printings are shown in Table 1.

[EXAMPLE 2]

An example 2 was carried out identically to that of example 1 of the present invention, except that barium ferrite having a magnetic force of 200 Gauss was replaced with the barium ferrite having a magnetic force of 500 Gauss. The results of 10,000 printings are shown in Table 1.

[EXAMPLE 3]

In this example, the laser printer (trade name: LBP-B406, marketed by Canon Co.) was utilized.

Figure 4:
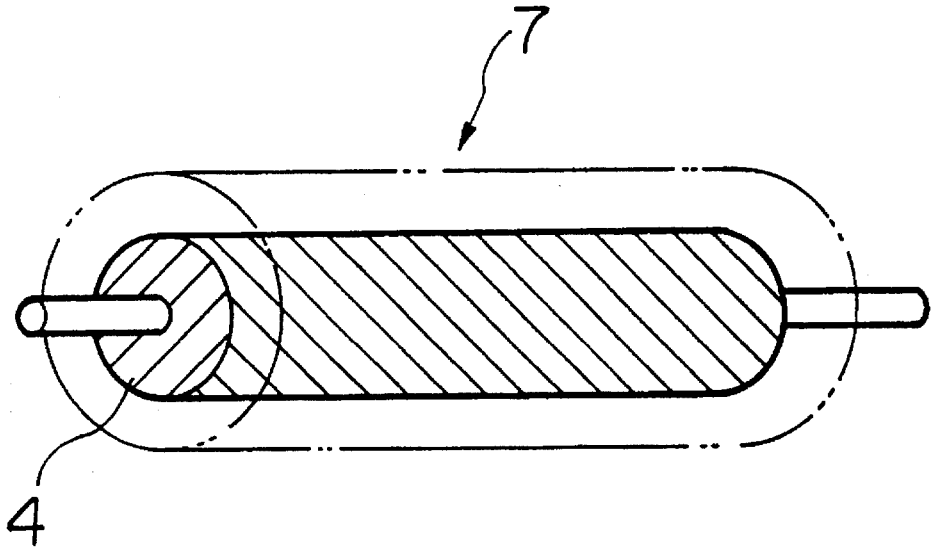
FIG. 4 is a schematic view, showing a transferring means of the present invention.
Figure 5:
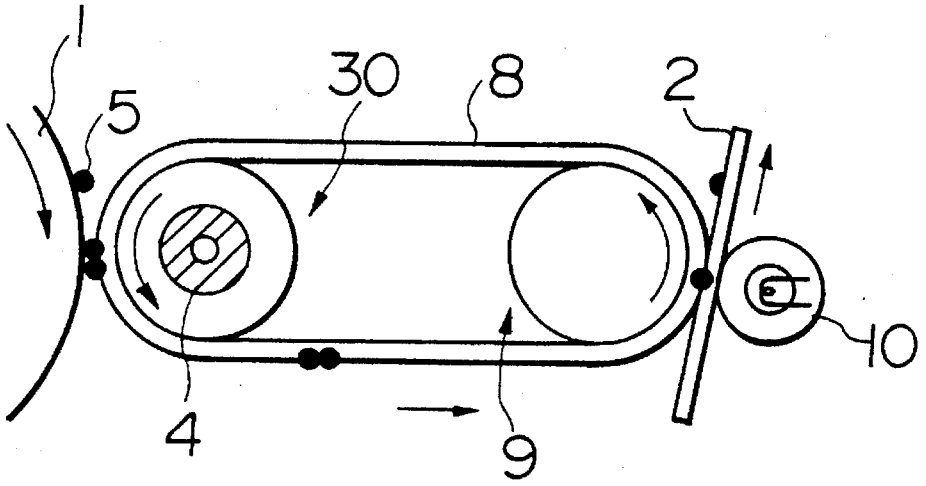
FIG. 5 is a schematic view, showing another method of transfer the present invention.
Figure 6:
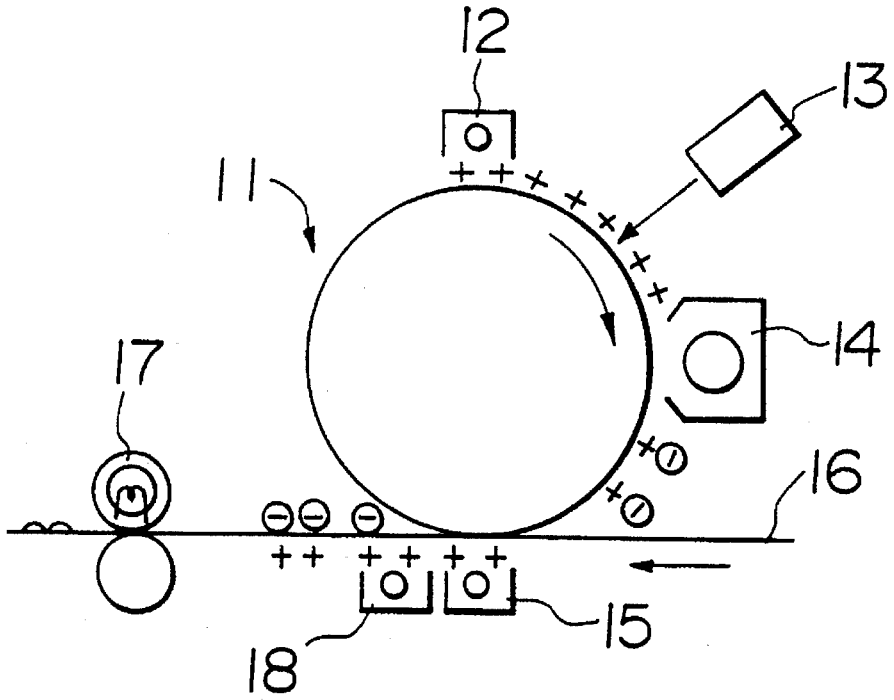
FIG.6 (PRIOR ART)
FIG. 6 is a schematic view, showing one conventional method of transfer.

As shown in FIG. 4, the core part of the transferring roller of the above laser printer is made of the magnetic material barium ferrites which has a magnetic force of 200 Gauss. The outside of the transferring roller is made of silicone rubber.

10,000 printings were carried out by the laser printer in which the supply of the magnetic toners was provided by the obtained by the above-described steps. The voltage for developing was set to 100 V. The results of 10,000 printings are shown in Table 1.

[EXAMPLE 4]

Example 4 was carried out identically to that of Example 3 of the present invention, except that barium ferrite having a magnetic force of 200 Gauss was replaced with the barium ferrite having a magnetic force of 500 Gauss. The results of 10,000 printings are shown in Table 1.

[Comparative Example 1]

A comparative example 1 was carried out identically to that of Example 1 of the present invention, except that the magnetic material positioned in the core part of the transferring corona generator was removed. The results of 10,000 printings are shown in Table 1.

[Comparative Example 2]

A comparative example 2 was carried out identically to that of Example 3 of the present invention, except that the magnetic material positioned in the core part of the transferring roller was removed. The results of 10,000 printings are shown in Table 1.

Table 1 shows the evaluated features such as image density, transfer efficiency, and blur.

The image densities were measured by a Machbeth illuminameter. The transfer efficiency was calculated from the formula described hereinbelow.

T=transfer efficiency

Uw=the weight of the magnetic toner used from the supply of the printer

Rw=the weight of the remaining magnetic toner

Then, T=(Uw−Rw)*100/Uw

The blur is evaluated by visual observation of a fine line. When the blur is judged to exist, then it is represented by the symbol "o" in Table 1. When the blur is judged to be nonexisitent, then it is represented by the "x" in Table 1.

TABLE 1

| Property | Image density | Transfer efficiency | Blur |
|---|---|---|---|
| Example 1 | 1.40 | 92 | ○ |
| Example 2 | 1.43 | 95 | ○ |
| Example 3 | 1.41 | 90 | ○ |
| Example 4 | 1.43 | 94 | ○ |
| Comparative | 1.15 | 68 | X |

TABLE 1-continued

| Property | Image density | Transfer efficiency | Blur |
|---|---|---|---|
| Example 1 Comparative Example 2 | 1.11 | 66 | X |

As shown in Table 1, it is confirmed that in examples 1 to 4 the image densities, transfer efficiencies, and blurs are superior to those of the comparative examples 1 and 2.

What is claimed is:

1. A method of transferring a magnetic toner to a paper sheet comprising the steps of:

disposing said magnetic toner on a surface of an image supporting member;

superimposing said paper sheet on said surface of said image supporting member; and transferring said magnetic toner to said paper sheet via transferring means, wherein said transferring means comprises a transferring corona generator which oppositely charges said paper sheet with respect to a charge on said magnetic toner and transfers said magnetic toner to said paper sheet via a magnetic force equal to at least 200 Gauss of a magnetic field produced by said transferring corona generator.

2. A method of transferring a magnetic toner to a paper sheet comprising the steps of:

disposing said magnetic toner on a surface of an image supporting member;

superimposing said paper sheet on said surface of said image supporting member; and transferring said magnetic toner to said paper sheet via transferring means, wherein said transferring means comprises an intermediate transferring member which accepts said magnetic toner by contacting said surface of said image supporting member on which said magnetic toner is disposed, a first transferring roller, having a magnetic material, which forces said intermediate transferring member into contact with said image supporting member, and a second transferring roller which forces said magnetic toner on said intermediate transferring member into contact with said paper sheet, said magnetic material producing a magnetic field having a magnetic force of at least 200 Gauss.

3. A method of transferring a magnetic toner according to any of claims 1 or 2, wherein said transferring means comprises a permanent ferrite magnet.

4. An electrophotographic recording device comprising:

an image supporting member having a surface on which magnetic toner is disposed; and transferring means, including a transferring corona generator which oppositely charges said paper sheet with respect to a charge on said magnetic toner, for transferring said magnetic toner to said paper sheet via a magnetic force equal to at least 200 Gauss of a magnetic field produced by said transferring corona generator.

5. An electrophotographic recording device according to claim 4, wherein said transferring corona generator comprises a container composed of said magnetic material.

6. An electrophotographic recording device comprising:

an image supporting member having a surface on which magnetic toner is disposed; and transferring means, including an intermediate transferring member which accepts said magnetic toner by contacting said surface of said image supporting member on which said magnetic toner is disposed, a first transferring roller, having a magnetic material, which forces said intermediate transferring member into contact with said image supporting member, and a second transferring roller which forces said magnetic toner on said intermediate transferring member into contact with said paper sheet, said magnetic material producing a magnetic field having a magnetic force of at least 200 Gauss.

7. An electrophotographic recording device according to claim 6, wherein said first transferring roller comprises a core portion composed of said magnetic material.

8. An electrophotographic recording device according to any of claims 4 or 6, wherein said transferring means comprises a permanent ferrite magnet.

* * * * *